United States Patent [19]

Schinn

[11] Patent Number: 4,815,486

[45] Date of Patent: Mar. 28, 1989

[54] PAINT EQUIPMENT CLEANING APPARATUS

[76] Inventor: Dale R. Schinn, P.O. Box 6133, Biloxi, Miss. 30532

[21] Appl. No.: 78,167

[22] Filed: Jul. 27, 1987

[51] Int. Cl.[4] ..... B08B 3/04

[52] U.S. Cl. ..... 134/111; 134/121; 134/155; 134/157

[58] Field of Search ..... 134/111, 121, 135, 138, 134/139, 141, 155, 157; 68/23 R

[56] References Cited

U.S. PATENT DOCUMENTS

| | | | |
|---|---|---|---|
| 1,525,756 | 2/1925 | McKenney et al. | 134/139 |
| 1,703,946 | 3/1929 | Melish | 134/141 |
| 2,965,111 | 12/1960 | Feigelman | 134/135 |
| 3,739,791 | 6/1973 | Fry et al. | 134/157 |

*Primary Examiner*—Philip R. Coe

*Attorney, Agent, or Firm*—Leon Gilden

[57] ABSTRACT

Paint equipment cleaning apparatus for performing the process of cleaning paint brushes, rollers, spray guns, and the like, includes the use of a pneumatically-powered equipment washing machine which holds a quantity of paint thinner or solvent. The painting equipment is moved through the solvent by the rotation of a holding drum in the washing machine, and the solvent is then removed so that the equipment may be spun dry through a rapid rotation of the drum. The removed solvent is pumped to a cleansing tank where it is filtered for reuse. The system is particularly adapted for use in a shipboard environment.

1 Claim, 2 Drawing Sheets

PAINT EQUIPMENT CLEANING APPARATUS

BACKGROUND OF THE INVENTION

1. Field of the Invention

The present invention relates to painting equipment, and more particularly pertains to a new and improved apparatus and for cleaning paint brushes, paint rollers and paint spray equipment.

2. Description of the Prior Art

The use of specially designed equipment for cleaning paint brushes, paint rollers and paint spraying equipment is well known in the prior art. A typical paint brush cleaning apparatus is disclosed in U.S. Pat. No. 2,449,818, which issued to A. Olsen on Sept. 21, 1948. In the Olsen device, a paint brush is rotatably retained within a bucket of paint thinner, and through the rotatable movement of a manually actuable handle, the brush is rotated within the thinner until substantially clean. The brush may then be removed for drying purposes. As will be noted in reference to this patent, the Olsen device is designed to hold and clean only one paint brush at a time, and a substantial amount of time and manual effort is required to clean the brush. Further, no means are provided for recycling and thus reusing the paint solvent contained within the device.

As to various prior art methods and apparatuses for cleaning paint rollers, a good typical example is to be found in U.S. Pat. No. 2,542,491, which issued to A. Engel on Feb. 20, 1951. The Engel device provides a holder by which a used paint roller may be attached to an electric drill. The paint roller may then be inserted into a bucket of paint thinner and is cleaned by being rotated within the thinner through an actuation of the drill. After cleansing, the roller is removed from the solvent and allowed to dry. Again, however, no means are provided for cleansing and reusing the paint thinner, and additionally, only a single paint roller can be cleaned at any given time.

There has been at least one attempt to manufacture an apparatus for cleaning and drying paint equipment wherein a plurality of items can be cleansed simultaneously with one container. In this regard, reference is made to U.S. Pat. No. 2,965,111, which issued to S. Feigelman on Dec. 20, 1960. The device shown in this patent includes a housing having a quantity of paint solvent retained therein, and a holding rack allows for the positioning of a plurality of paint brushes and rollers within the solvent. A handle on the housing allows the same to be manually agitated to effect a cleansing of the equipment. Additionally, the equipment may then be hung to dry within the housing above the surface level of the solvent. No means are illustrated for cleansing the solvent for purposes of reuse, and the agitation of the housing must be manually performed.

Accordingly, it would appear that there exists a continuing need for new and improved apparatuses and processes for cleansing paint equipment wherein a large quantity of equipment could be simultaneously cleaned with little or no effort being provided by the user of the equipment. In this respect, the present invention substantially addresses this need.

SUMMARY OF THE INVENTION

In view of the foregoing disadvantages inherent in the known types of apparatuses for cleaning painting equipment now present in the prior art, the present invention provides an improved apparatus and associated process for cleaning painting equipment wherein a pneumatically-powered rotatable washing machine is utilized to effect a cleansing thereof. As such, the general purpose of the present invention, which will be described subsequently in greater detail, is to provide a new and improved apparatus and process for cleaning painting equipment which has all the advantages of the prior art apparatuses and processes for cleaning such equipment and none of the disadvantages.

To attain this, the present invention comprises a pneumatically-powered rotatable washing machine having a plurality of holding hooks on which paint brushes and rollers can be hung. The machine is designed to retain a quantity of paint thinner or solvent, and the rollers and brushes will then be suspended into the solvent during a cleaning operation. Additionally, wire baskets may be hung into the solvent, with the baskets performing the function of holding paint spray gun equipment and the like.

The present invention is particularly adapted for use in a shipboard environment which already includes a supply of high and low pressure air. This air is utilized to rotate the solvent holding drum within the washing machine and can continue in operation until the equipment is substantially clean. The used solvent is then pumped from the drum into a holding and filtering tank which removes contaminants so that the thinner can be reused. After the thinner has been pumped out of the machine, the air power supply can be used to again rotate the drum which results in a spin drying operation for the equipment contained therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved painting equipment cleaning apparatus which has all the advantages of the prior art painting equipment cleaning apparatuses and none of the disadvantages.

It is another object of the present invention to provide a new and improved painting equipment cleaning apparatus which may be easily and efficiently manufactured and marketed.

It is a further object of the present invention to provide a new and improved painting equipment cleaning apparatus which is of a durable and reliable construction.

An even further object of the present invention is to provide a new and improved painting equipment cleaning apparatus which is susceptible of a low cost of manufacture with regard to both materials and labor, and which accordingly is then susceptible of low prices of sale to the consuming public, thereby making such painting equipment cleaning apparatus economically available to the buying public.

Still yet another object of the present invention is to provide a new and improved painting equipment cleaning apparatus which provides in the apparatuses and methods of the prior art some of the advantages thereof, while simultaneously overcoming some of the disadvantages normally associated therewith.

Still another object of the present invention is to provide a new and improved painting equipment cleaning apparatus which is particularly adapted for shipboard use.

Yet another object of the present invention is to provide a new and improved painting equipment cleaning apparatus which includes the use of a pneumatically-powered equipment washing machine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
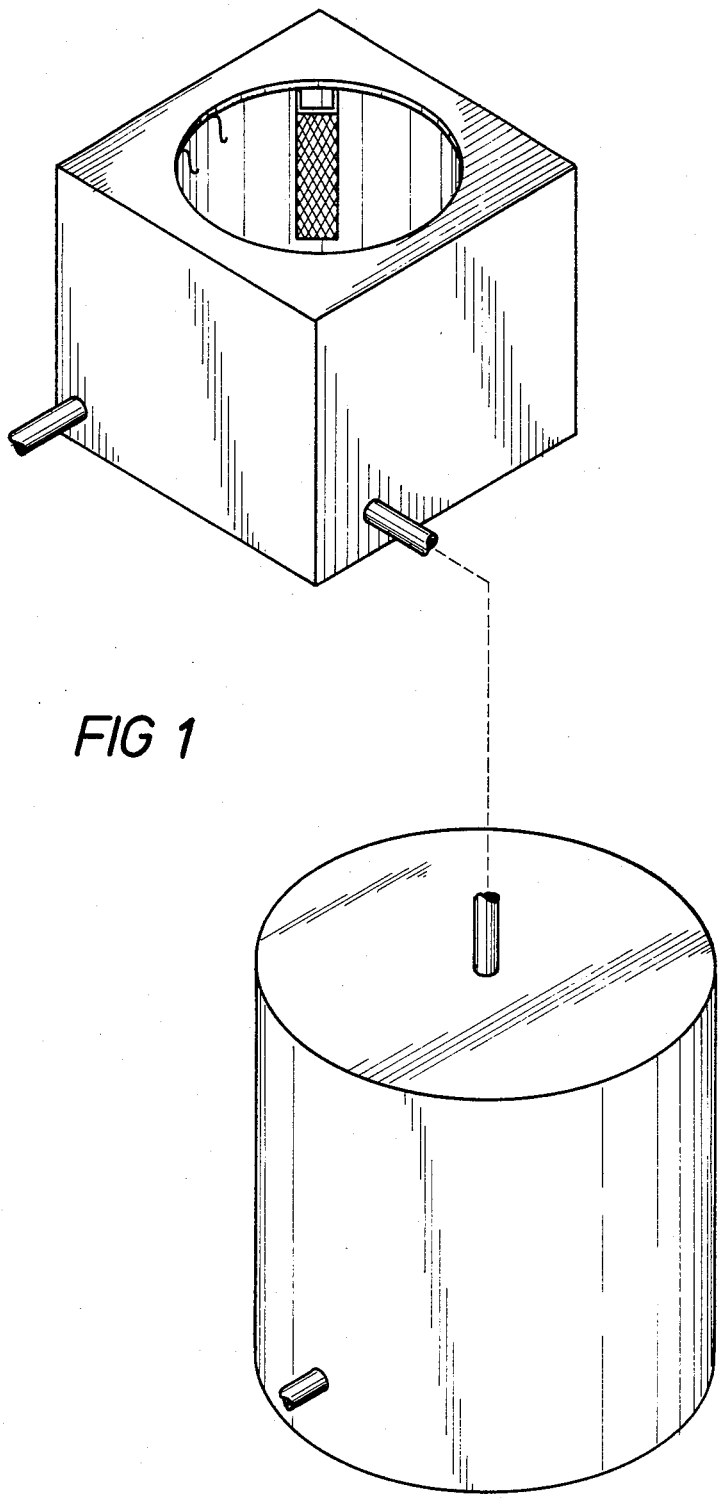
FIG. 1 is a perspective view of the painting equipment cleaning apparatus comprising the present invention.
Figure 2:
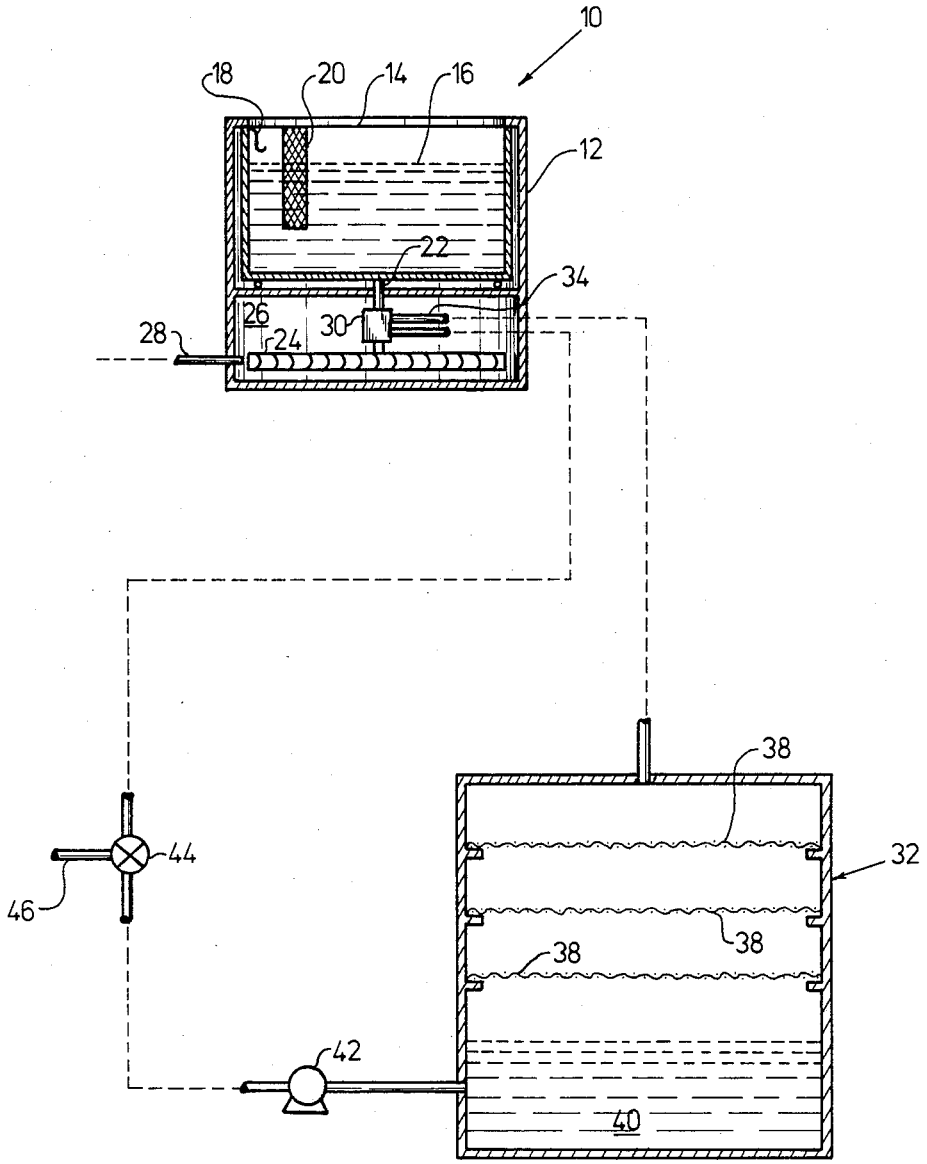
FIG. 2 is a side elevation view, partly in cross-section, illustrating the operable components of the invention.

With reference now to the drawings, and in particular to FIGS. 1 and 2 thereof, a new and improved paint equipment cleaning apparatus embodying the principles and concepts of the present invention and generally designated by the reference numeral 10 will be described.

More specifically, it will be noted that the paint equipment cleaning apparatus 10 essentially includes an equipment washing machine 12 having a solvent holding drum 14 rotatably mounted therein. In this regard, the drum 14 is designed to be substantially filled with a paint thinner or solvent 16, while a plurality of hooks or retaining clamps 18 are mounted around a periphery of the drum. The hooks 18 or retaining claims are designed to retain paint brushes and rollers in a suspended condition within the solvent 16. Additionally, one or more wire baskets 20 can be mounted interiorly of the drum 14, with these baskets being suspended in the solvent 16 and being designed to retain other painting equipment such as paint spray gun nozzles, etc.

As illustrated, the drum 14 is mounted upon a rotatable shaft 22 and an opposed end of the shaft has an impeller 24 fixedly secured thereto. The impeller 24 is mounted within a chamber 26 forming a bottom portion of the washing machine 12, and a supply of compressed air 28 is selectively operable to effect a rotation of the impeller.

Mounted to the shaft 22 is a conventional washing machine discharge pump 30 which, in response to a timer mechanism, will withdraw the solvent 16 from the drum 14 and then discharge it into the top section of a solvent cleaning tank 32. The pump 30 includes a discharge connection 34, with solvent 16 being directed through a hollow interior portion of the rotatable shaft 22 and then being directed through an attached conduit 36 to the thinner holding tank 32.

The solvent cleaning tank 32 includes a plurality of manually removable disposable filtering screens 38, and the used solvent then filters through the screens into a bottom section 40 of the tank. A further pump 42 can then be selectively activated to remove solvent 16 from the holding section 40 and return it through the pump 30 into the drum 14 for reuse. Alternatively, a direction diverting valve 44 can be utilized to direct the reused solvent through a discharge line 46 when a further reuse thereof is impractical.

As to the manner of usage and operation of the present invention 10, the same should be apparent from the above description. However, a brief description thereof will be provided. In this respect, it can be appreciated that the present invention is particularly adapted for shipboard use in the U.S. Navy. Due to the large amount of painting and cleaning required in ships, the U.S. Navy does not have sufficient cleaning equipment available at all times, and a large amount of money is wasted on ruined paint brushes and rollers, as well as dirty cleaning solvent. Through the use of the present invention, a plurality of paint brushes and rollers can be attached to the hooks 18, or retaining clamps and other equipment can be deposited in a basket 20. Available air is then pumped through the conduit 28 to effect a rotation of the impeller 24 and this in turn effects a concurrent rotation of the drum 14 whereby the brushes, rollers, and the like are moved in an agitated manner within the solvent 16. After a preselected cleaning period has expired, the pump 30 may be actuated to remove the solvent 16 from the drum 14, and with the drum still spinning, the painting equipment is spun dry. By the same token, the paint solvent 16 is filtered through the disposable filters 38 within the cleaning tank 32 and is then available for several reuses before a discarding thereof.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved painting equipment cleaning apparatus comprising:

paint solvent holding tank means for containing paint solvent;

drum means rotatably mounted in said paint solvent holding tank means;

paint equipment holding means mounted in said drum means wherein said paint equipment holding means includes a series of individual securement members integrally mounted to an internal periphery of the drum means for securement of painting equipment, and pneumatic power supply means for selectively rotating said drum means to both cleanse and spin dry said painting equipment contained therein; and first pump means for selectively removing said paint solvent from said drum means after a use thereof, and further including a separate cleaning tank means remotely positioned to said drum means for receiving said solvent removed from said drum by said first pump means, said cleaning tank means being operable to cleanse said solvent so as to make said solvent available for reuse, and wherein said cleaning tank means includes a plurality of spaced filters overlying a solvent holding section for removing contaminants from said paint solvent, and wherein said filters are disposable, and further including second pump means for removing said paint solvent from said solvent cleaning tank means, and wherein said second pump means delivers said paint solvent back to said drum means for purposes of reuse.

* * * * *